US005588629A

United States Patent [19]

Barnes

[11] Patent Number: 5,588,629

[45] Date of Patent: Dec. 31, 1996

[54] WALL ARTICLE HANGING DEVICE

[76] Inventor: Renny H. Barnes, 8146 Crestridge Rd., Fairfax Station, Va. 22039

[21] Appl. No.: 445,698

[22] Filed: May 22, 1995

[51] Int. Cl.[6] ..... A47F 7/14

[52] U.S. Cl. ..... 248/475.1; 40/757; 248/217.3

[58] Field of Search ..... 248/475.1, 477, 248/478, 489, 546, 547, 216.1, 216.4, 217.3, 217.2, 218.3, 497; 40/757, 759

[56] References Cited

U.S. PATENT DOCUMENTS

| | | | |
|---|---|---|---|
| 826,125 | 7/1906 | Steinmetz | 411/458 |
| 1,297,584 | 3/1919 | Mock | 248/489 |
| 1,426,232 | 8/1922 | Theodorsen | 403/283 |
| 1,995,173 | 3/1935 | Ehle et al. | 411/59 |
| 1,999,575 | 4/1935 | Reuter et al. | 248/497 |
| 2,099,273 | 11/1937 | Myer | 403/281 |
| 2,100,415 | 11/1937 | Theodorsen | 411/460 |
| 2,448,137 | 8/1948 | Cody | 248/497 |
| 2,533,786 | 12/1950 | Gagnier | 52/511 |
| 2,757,390 | 8/1956 | Sutton et al. | 5/416 |
| 3,841,195 | 10/1974 | Jureit | 411/459 |
| 5,069,412 | 12/1991 | Jacob | 248/493 |
| 5,328,139 | 7/1994 | Barnes | 248/475.1 |

*Primary Examiner*—Ramon O. Ramirez
*Attorney, Agent, or Firm*—Lowe, Price, LeBlanc & Becker

[57] ABSTRACT

A wall article hanging device includes a metal plate having one or more prongs angled from a surface thereof for angled penetration into a wall surface such as gypsum board or sheet rock. The metal plate is flushly and rigidly attached to a rear surface of a wall article such as a picture frame using one or more prongs in opposed relationship to the wall attaching prongs. The wall plate may be elongate in shape with a plurality of opposed prongs in spaced relationship to facilitate level and flush attachment. The wall plate may include one or more through openings and fastening means to permit rigid and flush attachment of the metal plate to a article to be hung on a wall surface.

19 Claims, 4 Drawing Sheets

WALL ARTICLE HANGING DEVICE

FIELD OF INVENTION

The invention is directed to a wall article hanging device and, in particular, to a picture frame hanging device providing a stationary, level and flush mount.

BACKGROUND ART

In the prior art, numerous devices have been proposed as fastening or joining means wherein elements are joined together. One type of fastener includes a plate like structure and opposed prongs. These fasteners typically join members or elements together as shown in U.S. Pat. No. 1,995,173 to Ehle et al or U.S. Pat. No. 826,125 to Steinmetz.

The prior art also teaches numerous devices for hanging pictures. In U.S. Pat. No. 1,999,575 to Reuter et al, a retainer is disclosed having a spike to detachably mount the retainer in the manner of a pushpin. The retainer also includes V-shaped prongs adapted to be pushed into a support in which the spike is engaged. The retainer of Reuter et al supports a picture frame by the projection 10 arranged for engagement of the picture frame hanging or suspending cord or wire. The retainer of Reuter et al does not rigidly attach to the picture frame or provide any penetration into the frame.

U.S. Pat. No. 2,448,137 to Cody discloses another picture hanger comprising a plate and a pair of spaced prongs and an opposing prong stamped from the body of the plate. The opposing prong is forced into the wall and the picture frame may then be hung from the upper pointed ends of the spaced prongs by pressing the lower inside edge of the upper rail of the picture frame onto the two spaced prongs. The plate is first driven into the wall followed by suspension of a picture frame.

However, disadvantages of prior art devices, including the patents to Cody and Reuter et al, include failure to provide a flush mount that conceals the picture hanging device and a rigid mount to maintain a picture frame in a level orientation. Accordingly, a need has developed to provide an improved wall article hanging device such as a picture hanger which provides a level and flush mount for a wall hanging article such as a picture frame.

In response to this need, the present invention overcomes the deficiencies in the prior art as noted above by providing a wall article hanging device which first attaches to the wall article and is subsequently placed on a wall surface. The inventive wall article hanging device provides a level, stationary and flush mounted wall hanging article.

SUMMARY OF THE INVENTION

It is a first object of the present invention to provide a wall article hanging device facilitating flush mounting of articles such as picture frames to a wall surface.

It is another object of the invention to provide a hanging device which, when installed, maintains a wall hanging article stationary and level on its mounted surface.

It is a further object of the present invention to provide a wall article hanging device which is simple and effective to use by directly mounting both the article and hanging device to a wall surface simultaneously.

Other objects and advantages of the present invention will be become apparent as a description thereof proceeds.

In satisfaction of the foregoing objects and advantages, the present invention comprises a wall article hanging device for attaching an article to a wall surface comprising an elongated plate having an upper and a lower edge and means extending outwardly from the plate for rigidly and flushly attaching the plate to a rear surface of the article. The plate also has at least a pair of spaced first prongs integrally formed and extending outwardly from the plate, and angled downwardly towards the lower edge to form an acute angle with respect to a transverse section of the plate, the prongs opposing the means for rigid and flush attachment and being designed for penetration and attachment to the wall.

In another embodiment, a wall hanging device for attaching an article to a wall surface comprises a plate having upper and lower edges. Each plate further comprises means for rigidly and flushly attaching the plate to a rear surface of the article and at least one prong, the prong extending outwardly from the plate and acutely angled toward the lower edge, the means for rigid and flush attachment further comprising an aperture in the plate and a fastener to be attached to the article by extending through said aperture to facilitate the rigid and flush attachment.

In yet another embodiment of the invention, a wall article hanging device is provided having a curvature to better secure a wall article when hung. In one embodiment, a pair of spaced apart prongs are located at opposing ends of an elongated plate. Between the prongs is a means for rigidly and flushly attaching the plate to rear surface of an article, preferably through holes to receive a fastener such as a nail or screw. The elongated plate has a curvature extending from the midpoint of the plate outwardly to the prongs. The curvature and the springiness of the material used for the plate directs the prongs inwardly after attachment to better secure the wall article.

In another aspect of this embodiment, the means for rigidly and flushly attaching the plate to a rear surface of the article are located between the prongs and the ends of the elongated plate. The plate has a curvature opposite the embodiment discussed above so that the prongs are directed outwardly after wall article attachment. A section of the plate between the prongs can include a saw tooth cut to engage a conventional picture hanging nail or the like.

The combination of the spaced apart prongs and means for rigidly and flushly attaching the plate to a rear surface of an article can also include any elongated plate having an extended central portion such that the means for rigidly and flushly attaching the plate to a rear surface of an article are spaced from a plane intersecting the two spaced part prongs. In this embodiment, a single prong can be used also.

BRIEF DESCRIPTION OF THE DRAWINGS

Reference is now made to the drawings accompanying the application wherein.

DESCRIPTION OF THE PREFERRED EMBODIMENTS

The wall article hanging device of the present invention overcomes many disadvantages associated with prior art devices. The inventive wall article hanging device permits a flush mount between the wall article to be hung and the wall surface. Further, the manner in which the wall article is hung is improved since the wall article hanging device can first be mounted to the wall article followed by attachment of the wall article and wall article hanging device to a wall surface. The rigid and flush attachment between the wall article hanging device and the wall article to be hung facilitates the maintenance of a level disposition of the wall article on a wall surface at all times.

Figure 1:
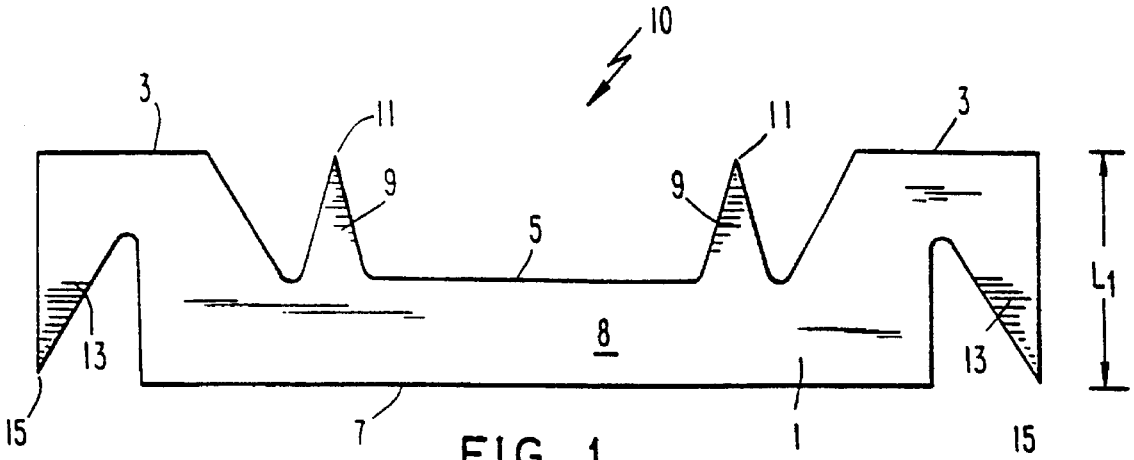
FIG. 1 is a front elevational view of a metal blank for use in a first embodiment of the invention.

With reference to FIG. 1, a first embodiment of the present invention is generally designated by the reference number 10 and is seen to include a metal blank 1. The metal blank 1 includes a pair of spaced edges 3, an edge 5 disposed therebetween and an edge 7 opposed to a portion of each of the edges 3 and the edge 5.

Extending outwardly from the edge 5 are a pair of spaced prongs 9, each prong terminating in a tip 11.

The plate 1 also includes a pair of spaced prongs 13 arranged at opposing end portions of the plate 1. Each of the prongs 13 terminate in a tip 15. The termination tip 15 of each of the prongs 13 is generally opposed to the tips 11 of the prongs 9.

The elongated plate 1 also includes a surface 8, the opposing surface not shown. The plate 1 has an overall width and length with the length designated as $L_1$.

Figure 2:
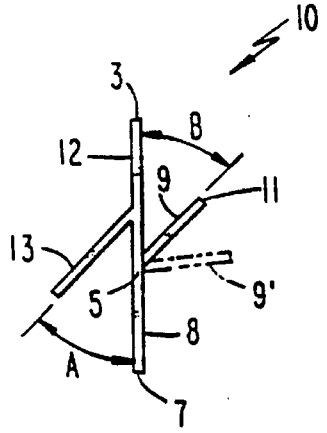
FIG. 2 is a side view of the metal blank depicted in FIG. 1 configured according to the first embodiment.

In the first embodiment of the invention, the prongs 9 and 13 of the plate 1 are angled in a fashion as depicted in FIG. 2. Prong 13 is shown at an angle "A" with respect to the surface 12, with the other prong not depicted being similarly angled.

The opposing prong 9, extending outwardly from the edge 5 and surface 8 is also angled with respect to the surface 8, the angle designated as the letter "B".

It should be understood that the angle "A" may vary depending on the gauge of the plate 1, the side length of prong 13 and anticipated weight of any wall article to be supported. The angle "A" is maintained as an acute angle to provide maximum holding power in a given wall surface having a preferred angulation of 10° to 60° and most preferred angulation of 15°.

The opposing prongs 9 may vary from an acute angle such as depicted in FIG. 2 up to a perpendicular orientation with respect to the surface 8 and as depicted in phantom and designated as 9' in FIG. 2. Likewise, and depending on the factors noted above for the prongs 13, the angle "B" may vary for each of the prongs 9.

Figure 3:
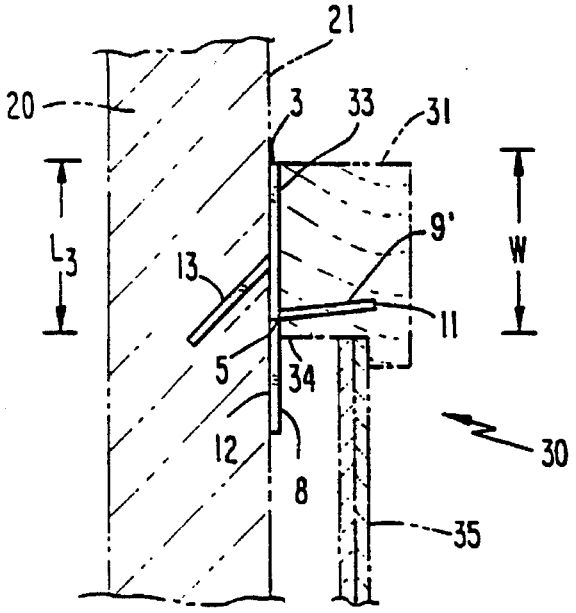
FIG. 3 shows the embodiment depicted in FIG. 2 in an exemplary use.

With reference now to FIG. 3, an exemplary use of the wall article hanging device depicted in FIG. 2 is illustrated. First, a wall 20 is provided having a wall surface 21 thereon. Second, a portion of a wall article, a picture frame, is generally designated by the reference numeral 30 and is seen to include a wooden frame member 31 and picture composite 35. The wooden frame 31 includes a rear surface 33.

In a method of using the inventive device, the opposing prongs 9' are driven into the wooden frame 31 of the picture frame 30. In the embodiment depicted in FIG. 3, the prongs 9' are shown extending generally in a perpendicular fashion from the surface 8. However, and as mentioned above, the prongs 9 may be angled acutely with respect to the surface 8 to provide improved holding power. For a lightweight frame, a perpendicular configuration of the prongs with respect to the surface 8 may be sufficient to support the picture frame 30 on the wall surface 21.

After the prongs 9' have been inserted, either manually by physically pressing the prongs 9' into the rear face 33 of the picture frame 30 or with the aid of an implement such as a hammer, the combination of the picture frame 30 and wall hanging device 10 are ready for attachment to the wall surface 21. The picture frame and wall article hanging device may then be positioned on the wall surface 21 such that the picture frame is level and pressed against the wall 20 such that the prongs 13 are driven into the wall. In a preferred embodiment, the wall 20 is made of sheet rock or drywall to facilitate ease of penetration by the prongs 13. However, the inventive device is adaptable for any readily penetratable wall surface. Once the prongs 13 have been fully inserted into the wall 20, the picture frame 30 is rigidly and flush mounted against the wall surface. The rigid attachment by virtue of the pair of spaced prongs 13 maintains the picture frame in a level configuration. The angulation of the prongs 13 with respect to the surface 12 of the wall article hanging device 10 provide adequate holding power to support the weight of the picture frame 30. Moreover, and by making the plate 1 of sufficiently thin gauge while maintaining sufficient strength in the prongs 9 and 13, the overall thickness of the wall plate 1 provides the appearance of a flush-mounted picture frame.

Still with reference to FIG. 3, it should be noted that the distance between the upper edge 3 and the intermediate edge 5 should be generally equal to or less than the frame member 31 width generally designated by the distance "W". If the distance between edges 3 and 5 exceeds the "W" distance, the upper edge 3 may be exposed for viewing or the lower edge 5 and any prongs extending therefrom may not be in sufficient proximity to permit rigid and flush attachment to a rear face 33 of the frame member 1 or another adjacent rear face such as face 34 depicted in FIG. 3.

It should be understood that the spacing and number of prongs as well as overall length of the plate may vary depending on the particular wall article to be hung. For example, a heavier wall article may require heavier gauge metal plate and more widely spaced opposing prongs. Likewise, and for a lighter wall article, a thinner gauge material may be used with more narrowly spaced prongs. Further, the prongs 9, although depicted inwardly of the prongs 13, may be disposed outwardly therefrom. In addition, three or more of prongs 9 or 13 may be employed when hanging a wall article.

Figure 4:
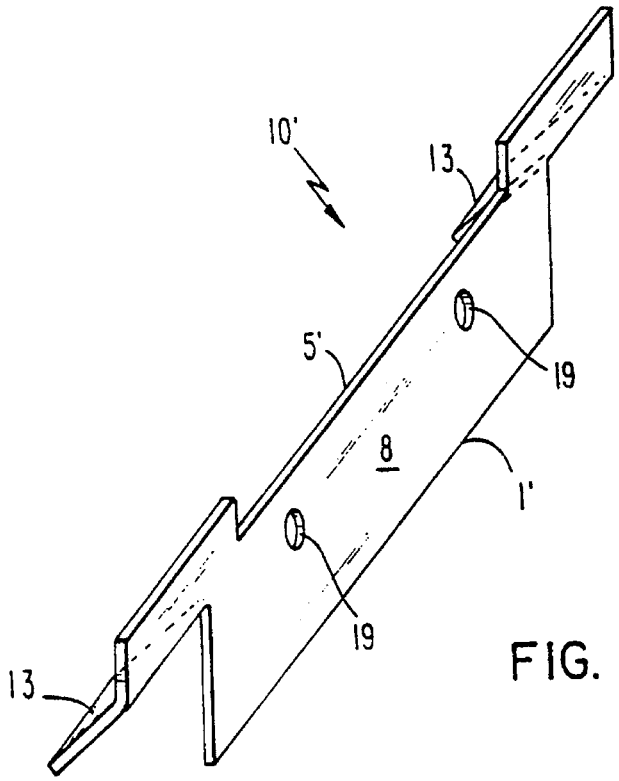
FIG. 4 is a perspective view of another embodiment of the inventive wall article hanging device.

With reference now to FIG. 4, an alternative embodiment to the wall article hanging device depicted in FIG. 1 is generally designated as 10'. In this embodiment, a metal plate 1' is shown having a pair of spaced through holes 19.

The through holes 19 facilitate rigid and flush attachment of the metal plate 1' to a wall hanging article such a picture frame using a fastener such as a screw or the like. The fastener should be of the type to facilitate a flush mount between the wall article to be hung and adjacent wall surface. The through holes 19 may be configured with a countersunk configuration to facilitate flush attachment. The wall article hanging device 10' is used in a similar manner as described above for the embodiment generally designated as reference numeral 10. That is, the metal plate 1 is rigidly and flush mounted to a rear surface of a wall article to be hung and subsequently attached to a wall surface using the prongs 13.

Although the through holes 19 are depicted adjacent the intermediate edge 5', other spacings may be contemplated by those skilled in the art depending on the particular wall article to be hung. In addition, the through holes 19 may be configured in different relationships with respect to the prongs 13 as described above for the opposing sets of prongs 9 and 13 shown in FIG. 2.

Figure 5:
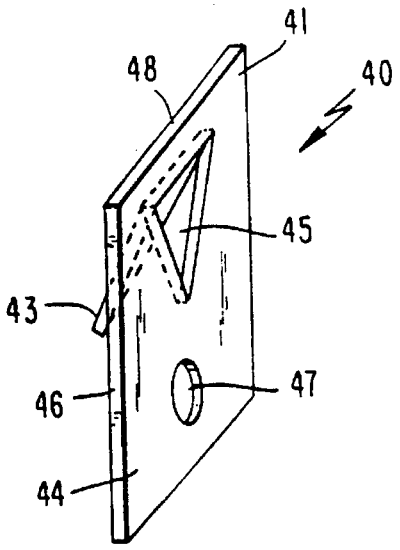
FIG. 5 is a further embodiment of the inventive wall article hanging device shown in perspective.

In another aspect of the invention, a wall article hanging device, generally designated by the reference numeral 40 is shown in FIG. 5. In this aspect, a metal plate 41 includes a prong 43 angled with respect to the plate surface 44 as described for FIG. 2. In this embodiment of the invention, the prong 43 is formed by a punching operation to leave a triangularly shaped opening 45 in the metal plate 41. Alternatively, the prong 43 could be formed in a similar manner as the prongs 9 or 13 formed in the metal blank 1 shown in FIG. 1. That is, the prong 43 may be formed from a blank having a triangularly shaped edge portion such that the triangularly shaped edge portion is bent to form the desired angular configuration with respect to the surface 44.

The wall article hanging device 40 also includes a through opening 47 similar to the through openings 19 shown in FIG. 4. The through opening 47 facilitates flush attachment to a wall article using a fastener such as a screw or the like. Again, the through hole 47 may be countersunk to facilitate the rigid and flush attachment as discussed above. The countersunk configuration is formed on the plate 41 on the surface 44 thereof as will be more clearly described in FIG. 6.

Figure 6:
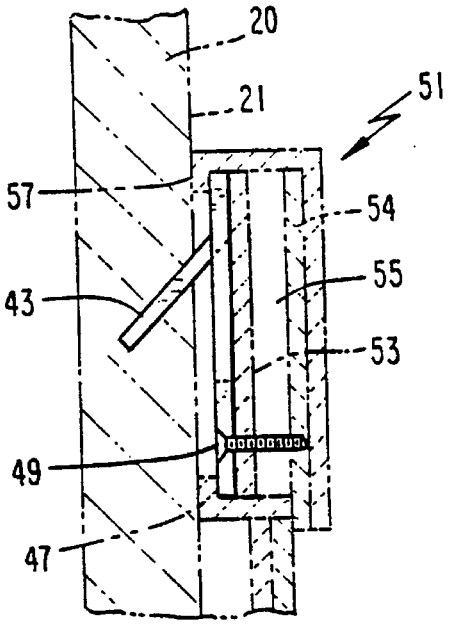
FIG. 6 shows the embodiment depicted in FIG. 5 in an exemplary use.

FIG. 6 shows an exemplary use the wall article hanging device 40 depicted in FIG. 5. A wall 20, for example, sheet rock or gypsum board, is provided having a surface 21. A metal picture frame 51 is shown in phantom which is typical of known metal picture frames which are secured together at the corners using L-shaped metal brackets and fasteners. These types of metal frames have a slot 55 and corresponding flange 57. The L-shaped corner plates 53 and 54 fit within the slot 55 and are wedged against the flanges 57 using a screw or other fastener to interconnect the picture frame corners together. In these type of picture frames, the inventive device 40 may be interdisposed between the L-shaped plate 53 and the flange 57 and attached using the fastener 49 to rigidly mount the wall article hanging device 40 within the slot 55 of the frame 51. In this manner of attachment, the prong 43 may then be inserted into the wall 20 to provide a rigid and flush attachment of the picture frame 51 to the wall surface 21.

It should be understood that a single wall article hanging device 40 having a pair of prongs 43 may be attached along a top frame member of the picture frame 51. Alternatively, a pair of the single prong wall article hanging devices 40 may be used in spaced apart locations along either a top or side members of the frame 51. When using a pair of devices 40 along side members of the picture frame 51, aligning each of the devices 40 facilitates level attachment to the wall surface 21. However, even if the spaced devices 40 are misaligned, level attachment of the picture frame 51 can be achieved by merely positioning the picture frame 51 in a level orientation prior to inserting the prongs 43 into the wall surface 21. By virtue of the prongs 43, level and flush attachment of the picture frame 51 is facilitated even if a plurality of devices 40 are used which are not perfectly aligned in spaced and level relationship along side or top members of the picture frame 51.

In yet another embodiment, the device 40 may include a pair of opposing prongs being angularly configured similar to the embodiment depicted in FIGS. 1–3.

With reference back to FIG. 5, it should be noted that the distance from the edge 46 to the center of the through hole 47 should not exceed the frame side member width. Otherwise, attachment of the device 40 to a picture frame may result in exposure of at least the edge 46 when a picture frame is hung on a wall surface. Similar distance tolerances should be observed between edge 48 and the through hole 47 when attached to a top frame member.

Although the wall article hanging device 40 is shown in an exemplary use with a metal frame, other types of frames may be used to achieve the rigid and flush attachment described above, for example a wood or plastic frame.

Figure 7:
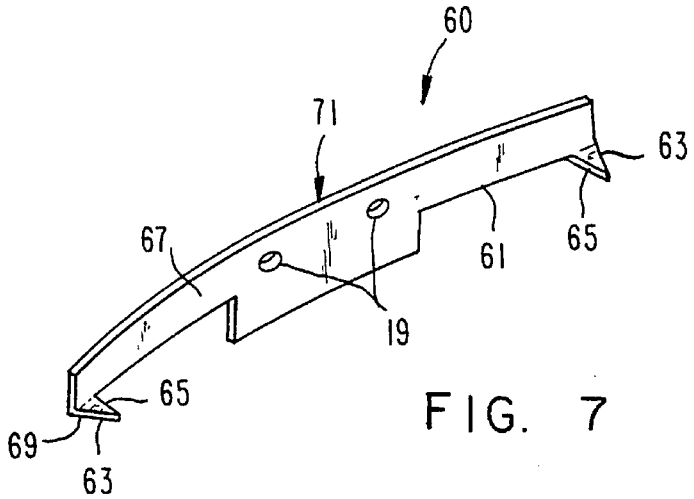
FIG. 7 shows an alternative embodiment of the invention.
Figure 8:
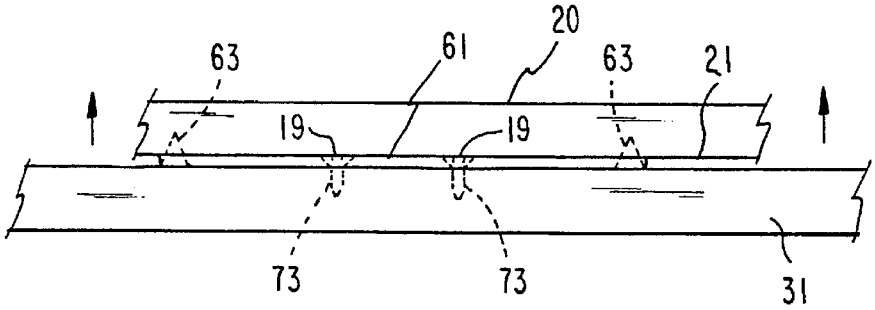
FIGS. 8 and 9 depict the embodiment shown in FIG. 7 in use.
Figure 9:
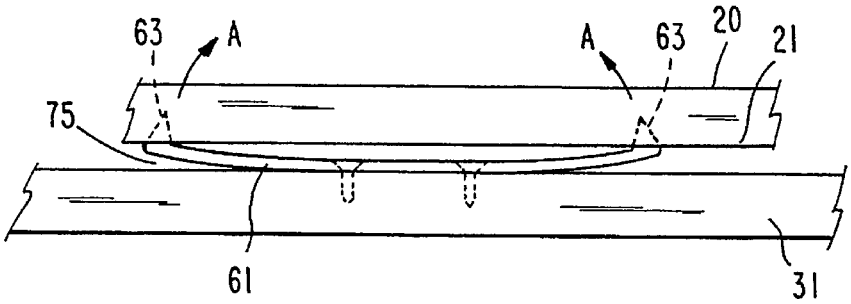

With reference now to FIGS. 7–9, an alternative embodiment to that depicted in FIG. 4 is generally designated by the reference numeral 60. The wall article hanging device 60 is in the form of an elongated plate 61 having prongs 63 on the ends thereof. Positioned between the prongs 63 are a pair of through holes 19. The prongs 63 are designed to enter a wall with the through holes 19 sized to receive a fastener such as a nail for rigid and flush attachment of the plate 61 to an article to be hung. Although two through holes 19 are shown, one or more than two can be used depending on the desired article to be hung.

Preferably, each prong 63 has a side edge 65 which is generally perpendicular to the face 67 of the plate 61. The opposing edge 69 is angled with respect to the face 67 for improved holding as described below. Of course, the edges 65 and 69 can both be angled towards a distal point of the prongs 63, if desired.

The elongated plate 61 has the curvature that extends from the mid point 71 of the plate 61 to each end of the plate. The curvature improves the holding power of the hanging device 60. The elongated plate 61 is made from a spring steel or the like to allow the plate 61 to flex during use.

In use, the elongated plate 61 is first attached to a wall article 31 using nails 73 in through holes 19, see FIG. 8.

Once the device 60 is attached to the wall article 31, pressure is applied to the wall article 31 against the wall 20 such that the prongs 63 penetrate the wall surface 21. FIG. 8 depicts the stage of installation when pressure is applied to the wall article 31 so that the elongated plate 61 is straightened due to the force applied against the wall article 31.

Once the prongs 63 penetrate the surface 21 and pressure is removed from the wall article 31, the spring in the plate 61 directs the prongs inwardly as designated by the arrows A to further grip the wall 20. The curvature in the plate 61 forms an angle of about 2° which is designated by the reference numeral 75 as measured from the mid point 71 of the plate 61 to its outer most edge. Of course, the degree of curvature can vary to adjust the amount of the angle 75 and the spacing between the wall 20 and article 31. A more severe curvature will provide a greater angle, a lesser degree of curvature providing a smaller angle and corresponding smaller gap between the wall and article.

Figure 10:
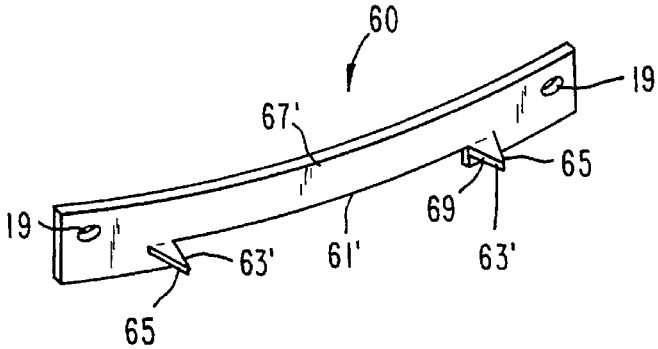
FIG. 10 is a further embodiment of the invention.
Figure 11:
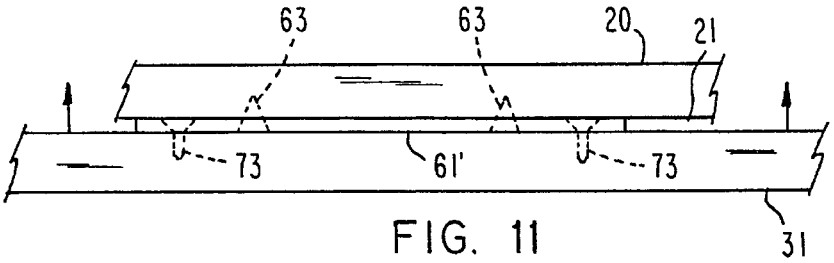
FIGS. 11 and 12 show the embodiment of FIG. 10 in use.
Figure 12:
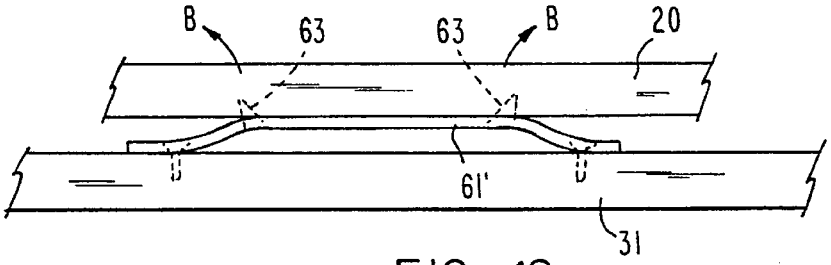

With reference now to FIGS. 10–12, an alternative embodiment generally designated by the reference numeral 60' has the prongs 63 positioned inwardly of the through holes 19 in the elongated plate 61'. In addition, the curvature of the plate 61 is opposite of that shown in FIG. 7. Moreover, the edges 65 which are generally angled to the face 67' of the plate 61 face the outer edges of the plate 61, the opposing angled edge 69 facing inwardly. This is opposite the configuration of the prongs 63 in FIG. 7 since the curvature is opposite.

Referring to FIGS. 11 and 12, the plate 61' is first attached to the wall article 31 using the nails 73. The plate-containing wall article 31 is then installed by applying force thereagainst such that the prongs 63' enter the surface 21 of the wall 20, see FIG. 11.

Once the wall article 31 is released, the plate 61 springs back to its original curvature, this movement directing the prongs 63 outwardly as designated by the arrows B. This outward movement enhances the attachment of the plate 61 to the wall 20. The degree of curvature can also be varied with this embodiment as described above for the embodiment depicted in FIG. 7.

Although through holes 19 are shown, the ends of the plate 61' can be fastened using staples for the rigid and flush attachment. Staples are more resilient and, therefore, more readily permit the spring action of the plate 61' as shown in FIG. 12.

Figure 13:
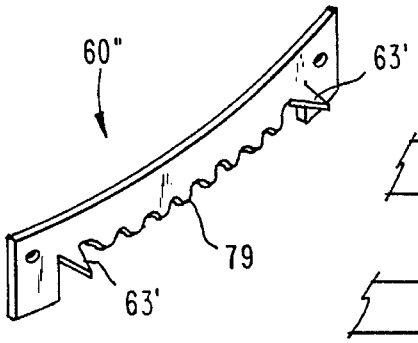
FIG. 13 is an alternative embodiment to that depicted in FIG. 10.

FIG. 13 shows an alternative embodiment to that of FIG. 10 which is designated by the reference numeral 60". In this embodiment, a saw tooth portion 79 is provided between the spaced apart prongs 63'.

Figure 14:
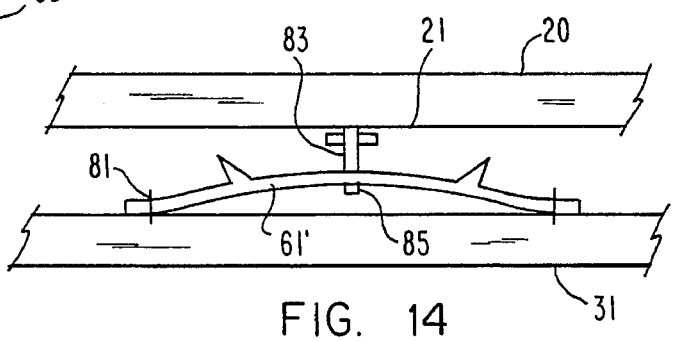
FIG. 14 shows the embodiment of FIG. 13 in use.

In FIG. 14, the plate 61 is shown secured with staples 81. The wall 20 includes a conventional picture hanger 83, the distal end 85 thereof engaging one of the teeth in the saw tooth portion 79. With the saw tooth portion 79, the hanger 60" can also act as a saw tooth hanger.

Figure 15:
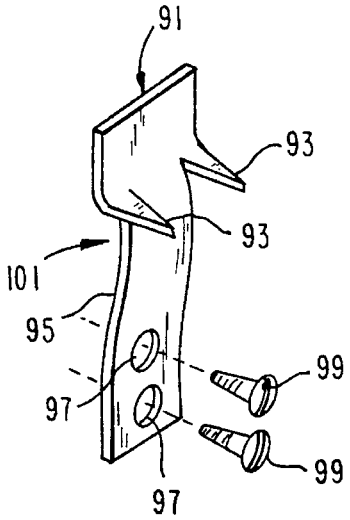
FIG. 15 shows an additional embodiment of the invention.
Figure 16:
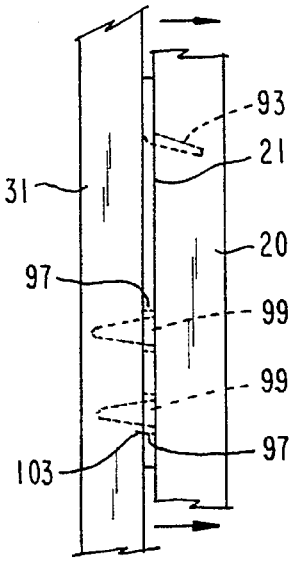
FIGS. 16 and 17 show the embodiment depicted in FIG. 15 in use.
Figure 17:
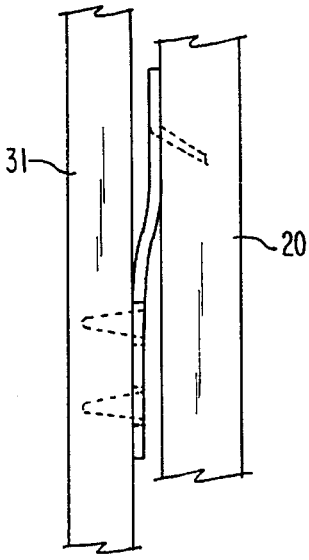

With reference now to FIGS. 15–17, another embodiment of the invention designated by the reference numeral 90 includes an elongated plate portion 91 having the spaced apart prongs 93 extend therefrom.

In this embodiment, the means for rigidly and flushly attaching the device 90 to a wall article to be hung is located on a leg 95 which extends from the plate portion 91. Through holes 97 are provided at the distal end of the leg to receive fasteners 99 for attachment to a wall article.

The device 90 also includes a curvature 101 similar to the curvature described above in FIGS. 7 and 10. That is, the curvature increases the holding power of the device 90 when used to hand a wall article.

In use, referring to FIGS. 16 and 17, the device 90 is attached to a wall article 31 using the screws 99. It should be understood that the through holes 97 are embossed to form a lip 103 surrounding the through hole, the lip 103 enhancing attachment to the wall article 31. This lip is typically formed by embossing the through holes. The embossing lip can also be used in the embodiments depicted in FIGS. 7 and 10 for through holes 19.

Once the device 90 is attached to the wall article 31, pressure is applied thereto to force the prong 93 into the wall surface 21, see FIG. 16.

Once the pressure on the wall article 31 is released, the curvature 101 allows the device 90 to take its natural curved shape as shown in FIG. 17. With this spring action, the wall article 31 is slightly passed from the wall 20, the spacing again approximate to the curvature in the device 90. The degree of curvature is similar that discussed above for the devices 60 and 60'.

The spring quality of the devices described above not only enhance the attachment to a wall but also allow for jostling of the wall article without loosening of the attachment where the prongs enter the wall surface. The spring or degree of curvature in the wall article hanging device allows the wall article such as a picture to be bumped or moved, this force being absorbed by the spring in the material rather than loosening the attachment of the prong in the wall. Consequently, improved attachment is realized between the wall article and wall with less chance that the prongs could be dislodged.

Referring again to FIG. 15, although a pair of spaced apart prongs 93 are shown, a single prong aligned with the center of the through holes 97 could be utilized for attachment to a given wall.

Although the prongs depicted in the embodiments above can vary in length and angulation, a preferred prong thickness of the plate 60 is 1/16 of inch with a length of about 5/32 of inch. The spring steel is preferably a low carbon spring steel in the tempered or untempered condition depending on the desired application. It should also be understood that the teachings described above for FIGS. 1–6 are equally applicable to the embodiments disclosed in FIGS. 7–17 where appropriate.

The metal plate material for use with the inventive wall article hanging device may be any known material having a sufficient combination of strength and ductility to be formed into a desired configuration. A preferred material includes a 1050 carbon spring steel. In addition, and although the thickness of the metal plate may vary, a preferred thickness would include 0.016 inches.

As such, an invention has been disclosed in terms of preferred embodiments thereof which fulfill each and every one of the objects of the present invention as set forth hereinabove and provide a new and improved wall article hanging device.

Various changes, modifications and alterations from the teachings of present invention may be contemplated by those skilled in the art without departing from the intended spirit and scope thereof. Accordingly, it is intended that the present invention only be limited by the terms of appended claims.

I claim:

1. A wall article hanging device for attaching an article to a wall surface comprising:

a) an elongated plate having an uppermost and a lower edge;

b) means extending outwardly from said plate for rigidly attaching said elongated plate to a rear surface of said article; and c) at least a pair of spaced prongs integrally formed and extending outwardly from said elongated plate, each said prong having an upper and a lower planar face decreasing in width from said elongated plate to a terminating tip said tip being angled downwardly towards said lower edge such that each said lower planar face forms an acute angle with respect to a transverse section of said elongated plate, said prongs in opposing relationship with said means for rigid attachment and designed for penetration of and attachment to said wall wherein;

d) said elongated plate has spring qualities and has a bend from a center thereof towards each end, said spring qualities causing said elongated plate to flatten during attachment to said wall and spring back after said attachment to direct said prongs in a direction generally opposite said spring back.

2. The hanging device of claim 1 wherein said means for rigid attachment further comprises at least one opening in said plate and a fastener sized to extend through said opening.

3. The hanging device of claim 2 wherein said at least one opening is embossed to form a lip therearound.

4. The hanging device of claim 1 wherein said prongs are located inwardly of said means for rigidly attaching and said bend causes a portion of said elongated plate between said prongs to be spaced from said wall article after said prongs are attached to said wall.

5. The hanging device of claim 4 further comprising a saw tooth portion on said lower edge of said elongated plate between said prongs.

6. The hanging device of claim 1 wherein said prongs are located at opposite ends of said elongated plate and outwardly of said means for rigidly attaching, said bend causing a portion of said elongated plate between each of said prongs and said means for rigidly and flushly attaching to be spaced from said wall article after said prongs are attached to said wall.

7. A wall article hanging device for attaching an article to a wall surface comprising:

a) an elongated plate having an uppermost and a lower edge;

b) means for rigidly attaching said elongated plate to a rear surface of said article; and c) at least one prong integrally formed and extending outwardly from said elongated plate, said prong having an upper and a lower planar face decreasing in width from said elongated plate to a terminating tip said tip being angled downwardly towards said lower edge such that said lower planar face forms an acute angle with respect to a transverse section of said elongated plate, said prong in opposing relationship with said means for rigid attachment and designed for penetration of and attachment to said wall, wherein said elongated plate has a leg portion having spring qualities and extending generally perpendicularly to said elongated plate, said leg portion including said means for rigidly attaching said elongated plate, said leg portion having a bend therein extending from said means for rigidly attaching towards said elongated plate, said spring qualities causing said leg portion to flatten during attachment to said wall end spring back after said attachment to direct said prong in a direction generally opposite said spring back.

8. The hanging device of claim 7 wherein said means for rigidly attaching further comprise at least one opening in said leg portion and a fastener sized to extend through said opening.

9. The hanging device of claim 8 further comprising a pair of openings.

10. The hanging device of claim 8 wherein said at least one opening is embossed to form a lip therearound.

11. A wall article hanging device for attaching an article to a wall surface comprising:

a) an elongated plate having an uppermost and a lower edge;

b) means extending outwardly from said plate for rigidly attaching said elongated plate to a rear surface of said article; and c) at least a pair of spaced prongs integrally formed and extending outwardly from said elongated plate, each said prong having an upper and a lower planar face decreasing in width from said elongated plate to a terminating tip said tip being angled downwardly towards said lower edge such that each said lower planar face forms an acute angle with respect to a transverse section of said elongated plate, said prongs in opposing relationship with said means for rigid attachment and designed for penetration of and attachment to said wall; wherein said elongated plate has spring qualities and has a bend from a center thereof towards each end, said spring qualities causing said elongated plate to flatten during attachment to said wall and spring back after said attachment to direct said prongs in a direction generally opposite said spring back.

12. The hanging device of claim 11 wherein said means for rigid attachment further comprises at least one opening in said plate and a fastener sized to extend through said opening.

13. The hanging device of claim 11 wherein said prongs are located inwardly of said means for rigidly attaching and said bend causes a portion of said elongated plate between said prongs to be spaced from said wall article after said prongs are attached to said wall.

14. The hanging device of claim 13 further comprising a saw tooth portion on said lower edge of said elongated plate between said prongs.

15. The hanging device of claim 14 wherein said elongated plate and said leg portion have spring qualities, at least said leg portion having a bend therein extending from said means for rigidly attaching towards said elongated plate, said spring qualities causing said leg portion to flatten during attachment to said wall end spring back after said attachment to direct said prongs in a direction generally opposite said spring back.

16. The hanging device of claim 11 wherein said prongs are located at opposite ends of said elongated plate and outwardly of said means for rigidly attaching, said bend causing a portion of said elongated plate between each of said prongs and said means for rigidly attaching to be spaced from said wall article after said prongs are attached to said wall.

17. The hanging device of claim 11 wherein said elongated plate has a leg portion extending generally perpendicularly to said elongated plate and between said prongs, said leg portion including said means for rigidly attaching.

18. The hanging device of claim 17 wherein said means for rigidly attaching further comprise at least one opening in said leg portion and a fastener sized to extend through said opening.

19. The hanging device of claim 18 further comprising a pair of openings.

* * * * *